United States Patent [19]

Pyne et al.

[11] 4,270,201

[45] May 26, 1981

[54] WATCH STRAP WITH ADJUSTABLE ATTACHMENT END

[75] Inventors: Bernard Pyne; Reginald W. H. Gray, both of Middlesex; Peter R. Barber, Surrey, all of England

[73] Assignee: Timex Corporation, Waterbury, Conn.

[21] Appl. No.: 108,898

[22] Filed: Dec. 31, 1979

[51] Int. Cl.[3] ..... G04B 37/00

[52] U.S. Cl. ..... 368/282; 368/316; 368/317

[58] Field of Search ..... 224/164, 166, 168, 177, 224/267; 368/282, 316, 317

[56] References Cited

U.S. PATENT DOCUMENTS

| | | | |
|---|---|---|---|
| 2,028,791 | 1/1936 | Lynds | 368/282 |
| 2,191,020 | 2/1940 | Kaufmann | 224/177 |
| 3,738,100 | 6/1973 | Hassman et al. | 368/282 |

*Primary Examiner*—Ulysses Weldon

*Attorney, Agent, or Firm*—Edward J. Timmer

[57] ABSTRACT

A molded plastic watch strap has an attachment end which includes a full loop adapted to be centrally positioned between the spaced lugs of a watch case and to receive a transverse connector bar for attachment to the lugs, upper loop extensions projecting toward the lugs from opposite sides of the central loop and defining lateral enclosures with open bottoms, and a pair of resilient legs attached to the wrist-side of the strap and terminating in auxiliary full loops adapted to be received at least partially in the lateral enclosures on opposite sides of the central loop. The auxiliary full loops receive the ends of the connector bar and can be moved inwardly or outwardly as a result of the resilience of the legs to adjust to different lug spacings. The auxiliary full loops are each sized so that there is some overlap relative to the upper loop extensions even when the auxiliary loops are extended to accommodate the maximum lug spacing, to thereby completely hide the connector bar from view.

6 Claims, 10 Drawing Figures

WATCH STRAP WITH ADJUSTABLE ATTACHMENT END

FIELD OF THE INVENTION

This invention relates in general to a watch strap and particularly to a nonmetallic watch strap having attachment ends which can be adjusted in width to accommodate watch cases with different lug spacings.

DESCRIPTION OF PRIOR ART

In the past, wrist watch straps of leather, plastic and the like have been made and sold in a number of different sizes to fit watch cases having different lug spacings. This system not only requires an extensive inventory with accompanying increased costs but also is inconvenient in that retailers and customers, especially of replacement straps, must exercise care to ensure that a particular watch strap fits suitably between the lugs of the watch case involved.

The Hirsch U.S. Pat. No. 3,991,921 issued Nov. 16, 1976, and the Ramaciere U.S. Pat. No. 4,149,662 issued Apr. 17, 1979, represent recent efforts to provide a watch strap with attachment ends capable of fitting different watch case lug spacings. The Ramaciere patent involves a non-metallic strap having a central longitudinal slip through the attachment end to define two terminal tabs which can be spread apart or compressed together to fit different lug spacings. A flanged bushing is inserted through the loop in each terminal tab and the ends of a coiled wire spring are inserted into the bushings so that the terminal tabs are forced apart by the force of the spring, the portion of the spring between the terminal tabs being visible to the wearer of the strap. Neither the Ramaciere nor the Hirsch patents are deemed completely satisfactory from a functional or asthetic standpoint.

Other patents illustrating watch straps with longitudinal slits through the attachment end, but for a different purpose, are the McAloon U.S. Pat. No. 2,461,693 issued Feb. 15, 1949; the Chappell U.S. Pat. No. 2,958,449 issued Nov. 1, 1960, and the Herzog U.S. Pat. No. 3,578,208 issued May 11, 1971.

The Vollet U.S. Pat. No. 3,118,209 issued Jan. 21, 1964, provides a metallic adjustable endpiece tube which can be inserted over the conventional spring connector bar and through the strap attachment end and includes detachable ends to accommodate different lug spacings. Likewise, well-known telescoping endpieces are available for insertion over the spring connector bar and through the strap end for the same purpose; for example, see the Vargas U.S. Pat. No. 4,023,243 issued May 17, 1977. Not only do these attachment systems require the presence of the adjustable endpiece in addition to the conventional spring connector bar but also they are disadvantageous from an aesthetic standpoint.

SUMMARY OF THE INVENTION

The present invention provides an improved watch strap having an attachment end which is attachable to the spaced lugs of a watch case by a connector bar and which is adjustable in width to accommodate different lug spacings on different watch cases and thereby hide the connector bar from view, all without the need for a special adjustable endpiece component. The improved strap can be used with a conventional spring connector bar or with a special spring connector having a greater than standard amount of telescopic movement so as to provide universal fit between watch case lugs having a predetermined range of spacings there between. The watch strap of the invention is thus advantageous over prior art straps from an aesthetic as well as functional standpoint.

These advantageous features associated with the watch strap of the invention are achieved by providing the strap attachment end with a full loop portion disposed between the spaced lugs and defining a transverse passage to receive an intermediate portion of the connector bar, upper loop extensions projecting outwardly toward the lugs on opposite sides of the central loop to define partial lateral enclosures with open bottoms, and a pair of reslient legs attached to the wrist (bottom) side of the strap and extending toward the partial lateral enclosures with each leg terminating in an auxiliary full loop adapted to receive the ends of the connector bar and to be adjusted inwardly or outwardly to accommodate the particular lug spacing involved. The width of the attachment end is made adjustable within limits by selecting the total width of the central loop and the upper loop extensions to equal the predetermined lower lug spacing limit and by selecting the width of each auxiliary full loop to at least slightly exceed one half of the additional width necessary to equal the predeterminal upper lug spacing limit. Thus, when the auxiliary end loops are fully retracted into the partial lateral enclosures, the attachment end of the strap will fit the smallest lug spacing and when they are extended out of the lateral enclosures, the maximum lug spacing can be accommodated with some slight overlap of the auxiliary loops by the upper loop extensions so that the connector bar remains hidden from view. Intermediate lug spacings are accommodated by suitable adjustment of the auxiliary loops into or out of the lateral enclosures.

The watch strap of the invention is preferably produced with the features described above at low cost by injection molding thermoplastic material into a suitably configured die cavity.

DESCRIPTION OF PREFERRED EMBODIMENTS

Figure 1:
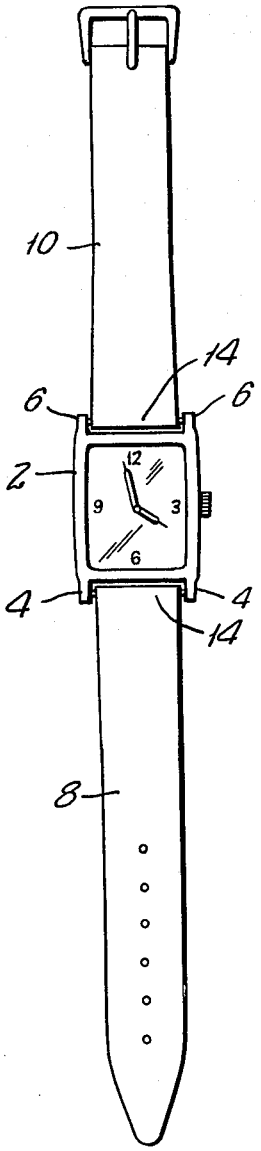
(PRIOR ART) FIG. 1
FIG. 1 is a top plan view of a conventional watch case with spaced lugs and a watch strap attched thereto.
Figure 2:
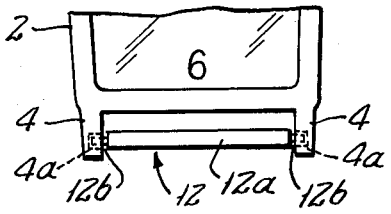
(PRIOR ART) FIG. 2
FIG. 2 in a top plan view showing a spring connector bar between the lugs of the watch case.

FIG. 1 shows a conventional wrist watch and watch strap attached thereto. The watch includes a case 2 having a pair of spaced lugs 4 and 6 projecting from opposite ends with the tongue portion 8 and the buckle portion 10 of the strap attached to lugs 4 and 6, respectively, by a spring connector bar 12 inserted through transverse loops in the strap ends in customary prior art fashion. The spring connector bar comprises cylindrical sheet metal tube 12*a* within which spring-urged pintles 12*b* are disposed and adapted to engage in bores 4*a* in lugs 4, FIG. 2, and in similar fashion to the lugs 6. Although conventional spring bars can be used with the strap of the invention, it is preferred to use a spring connector bar which has a greater than standard amount of telescopic movement of the spring-urged pintles within the cylindrical tubes so that a preselected range of lug spacings; e.g. a $\frac{1}{8}$ inch lug spacing range can be accommodated by the spring connector bar. In this way, only one spring bar will be required for use with the inventive strap.

Figure 3:
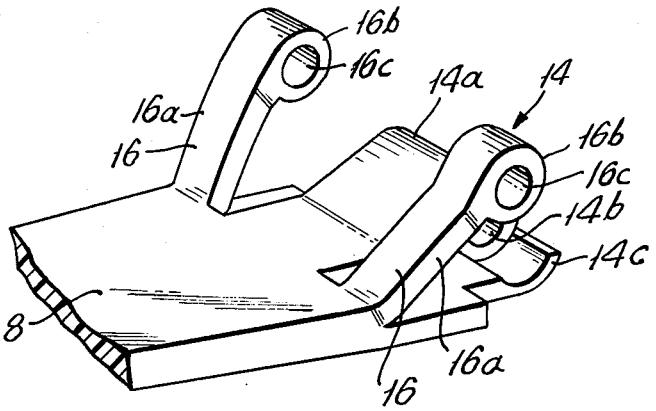
FIG. 3 is a partial perspective view of the watch strap of the invention showing the attachment end.
Figure 4:
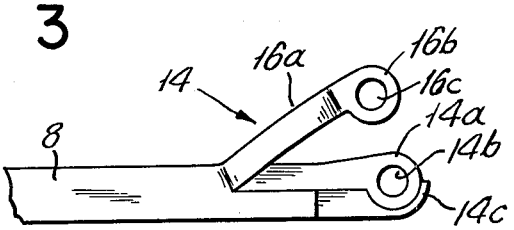
FIG. 4 is a side plan view of FIG. 3.

The important feature of the watch strap of the invention resides in the construction of the attachment end 14 which carries the spring connector bar 12 and which is attached between the spaced watch case lugs by the connector bar. FIGS. 3 and 4 show a preferred strap attachment end construction; namely, a full (360°) loop portion 14*a* adapted to be more or less centrally disposed between the spaced lugs and defining transverse passage 14*b* for receiving intermediate portions of the cylindrical tube 12*a* of the spring connector bar. Projecting outwardly from the opposite ends of the full loop portion are upper loop extensions 14*c* which are formed generally in the configuration of a one-half loop portion as shown best in FIG. 4 and which define a partial lateral enclosure with an open bottom on the opposite ends of the full loop portion. The upper loop extensions 14*c* function to hide that portion of the spring connector bar therebehind and are sized and shaped to receive the auxiliary loops 16*b* of resilient legs 16.

Legs 16 each include an elongated stem portion 16*a* molded at one end to the bottom (wrist-side) of the strap in spaced relation from but extending longitudinally toward strap end 14 with each leg terminating in an auxiliary full loop 16*b* defining a transverse passage 16*c* to receive the ends of the connector bar 12. As shown in FIG. 3, one resilient leg 16 is disposed on each side of the strap bottom (wristside) and extends toward the respective partial lateral enclosure on opposite sides of the central loop. In this configuration, the auxiliary loops are sized to fit in the lateral enclosures formed by the upper loop extensions 14*c*. Due to the resiliency of the legs 16, the auxiliary loops 16*b* are slidable inwardly or outwardly relative to the upper loop extensions 14*c* and along the length of the connector bar ends to adjust to various lug spacings involved with different watch case styles. Preferably, the transverse passage 16*c* of each auxiliary full loop is somewhat smaller than transverse passage 14*b* of the full loop portion 14*a* so that the auxiliary loops function to center the spring connector bar between the watchcase lugs. Each transverse passage 16*c* may be tapered for this purpose or include a section of reduced size.

The adjustability of the watch strap is of course selected to correspond to a predetermined lower lug spacing limit and a predetermined upper lug spacing limit associated with commonly used men's watches or a particular watch case line, for example, a $\frac{5}{8}$ inch lower lug spacing and $\frac{3}{4}$ inch upper lug spacing for a typical men's watch. The lower limit of adjustability is met by selecting the total width of the central loop 14*a* and upper loop extensions 14*c* to be equal to the lower lug spacing limit. The upper limit, on the other hand, is provided by selecting the width of each auxiliary full loop 16*b* to slightly exceed one half of the additional width necessary to equal the maximum lug spacing limit. For example, when the lower lug spacing limit is $\frac{5}{8}$ inch and the upper lug spacing limit is $\frac{3}{4}$ inch, it has been found satisfactory to mold the auxiliary loops each with a width of $\frac{1}{8}$ inch. In this way, the auxiliary loops can each be extended outwardly by the 1/16 inch required to adjust to the upper limit and still have 1/16 inch overlap with the upper loop extensions to ensure that the connector bar remains hidden from view. Of course, the width of the auxiliary loops could be less than $\frac{1}{8}$ inch, if desired, so long as some slight overlap with the upper loop extensions is provided to hide the connector bar.

Figure 6A:
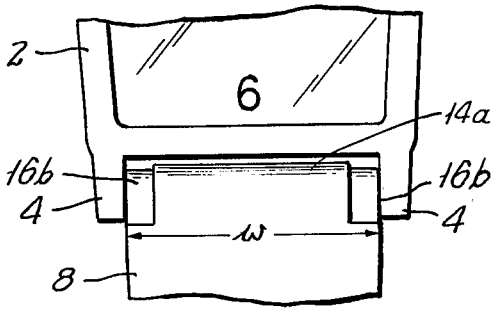
FIGS. 6*a* and 6*b* are top plan views corresponding to FIGS. 5*d* and 5*b* but with the strap attached to the spaced lugs of the watch case.
Figure 6B:
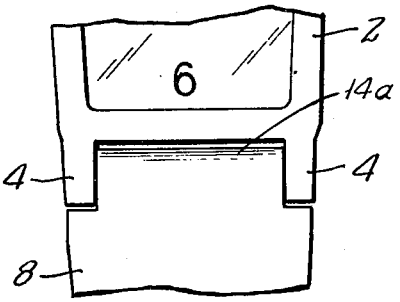
Figure 5A:
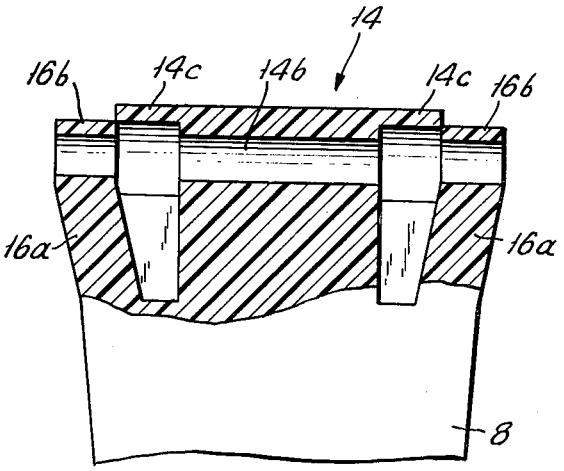
FIG. 5*a*–5*d* are rear plan views of the attachment end of the watch strap with the resilient legs extended for various lug spacings.
Figure 5B:
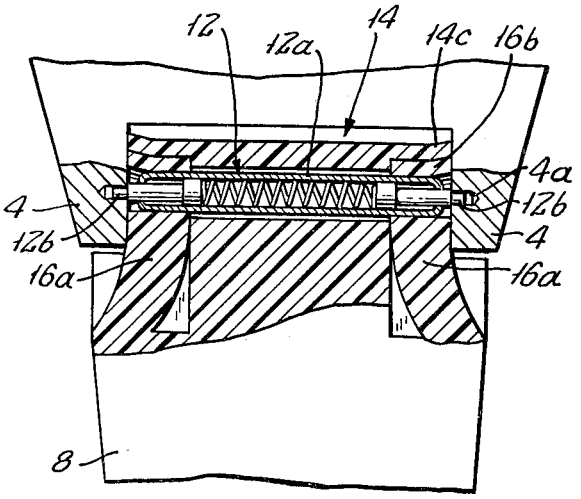
Figure 5C:
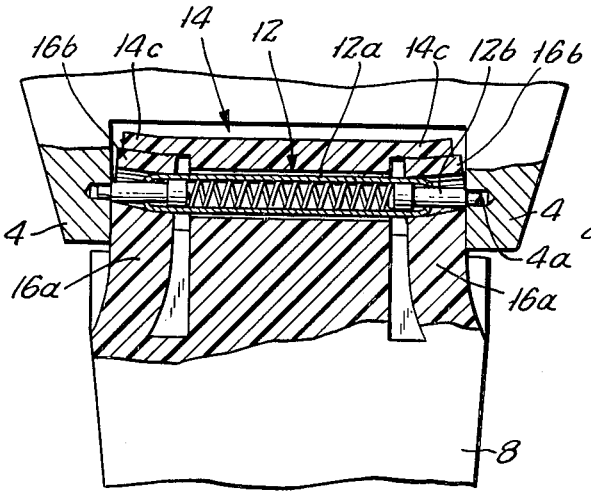
Figure 5D:
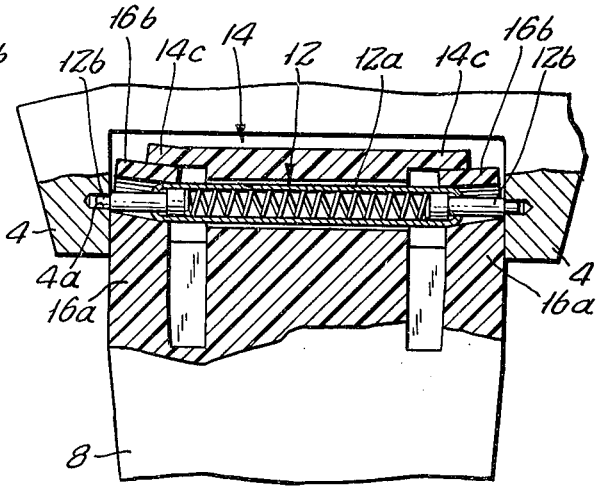

Generally, in molding the watch strap of the invention the legs 16 preferably are molded in the outwardly extended position, i.e., extending past the upper loop extensions 14*c* by generally greater than 1/16 inch as shown in FIG. 5(*a*). In this way, the legs are biased outwardly to acccommodate the upper lug spacing limit and any limit therebelow. When adjustment for different lug spacings is required, the legs can be resiliently compressed into the lateral enclosures on the sides of the central loop behind the upper loop extensions, e.g., as shown in FIG. 5(*b*) for a $\frac{5}{8}$ inch lug spacing, in FIG. 5(*c*) for a 11/16 inch lug spacing and in FIG. 5(*d*) for a $\frac{3}{4}$ inch lug spacing. Further, to provide the best fit of the auxiliary full loops 16*b* in the lateral enclosures without undue distortion, especially for smaller lug spacings, it is preferred to mold auxiliary loops 16*b* such that each extends outwardly at an angle relative to the long axis of the strap, rather than generally parallel to the axis as in FIG. 5(*a*). FIGS. 6*a* and 6*b* illustrate the appearance of the watch strap as engaged to lugs with the upper spacing ($\frac{3}{4}$ inch) and lower spacing ($\frac{5}{8}$ inch), respectively. It is apparent that the connector bar is completely hidden from view in both figures even though the lug spacing varies from the maximum to the minimum limit. The width, w, of the watch strap adjacent the attachment end 14 is shown as equal to the maximum lug spacing. This is preferred from an aesthetic standpoint but other strap dimensions may be used if desired. It is also apparent that no additional component such as a telescoping endpiece is required to achieve the "adjusted" look of the invention.

If desired, the spring connector bar described hereinabove can be replaced with a manually operable connector bar which allows easy disengagement of the strap from the lugs for replacement purposes or styling changes. In such a situation, the watch strap of the invention would have an access opening molded therein on the bottom side so that the connector bar can be manually operated. One manually operable connector bar which might be used with the strap is described in copending U.S. patent application Ser. No. 973,220 filed Dec. 26, 1978, now U.S. Pat. No. 4,217,681 and of common assignee herewith. If desired, the watch strap could be molded in situ around such a connector bar.

Although it is preferred to injection mold the present watch strap from thermoplastic material, it may be possible to use leather, fabric or other materials if resiliency can be imparted thereto, at least in the areas forming legs 16. And, while only certain embodiments of the present invention have been illustrated and described, it will be apparent to those skilled in the art that various changes and modifications may be made therein without departing from the spirit and scope of the invention as covered in the appended claims.

We claim:

1. A watch strap useful with a connector bar for attachment between the spaced first and second lugs of a watchcase and having a bottom surface facing a wearer's wrist, said watch strap including an attachment end adapted to fit between the spaced lugs and to be adjustable in width to accommodate different lug spacings, said attachment end having first and second lateral enclosures hidden from the wearer's view in the bottom surface for positioning adjacent the respective first and second lugs of the watchcase and further having a pair of resilient legs attached to the bottom surface with the legs extending toward the first and second lateral enclosures, each leg terminating in a loop adapted to be at least partially received in a respective one of the first and second lateral enclosures and adapted to receive a respective one of the opposite ends of the connector bar when said strap and connector bar are attached to the first and second lugs, said legs being sufficiently resilient that the loops associated therewith can each be moved along the connector bar toward or away from the first and second lugs to accommodate different lug spacings.

2. A watch strap useful with a connector bar for attachment between the spaced first and second lugs of a watchcase and having a bottom surface facing a wearer's wrist, said watch strap including an attachment end adapted to fit between the spaced lugs and to be adjustable in width to accommodate different lug spacings, said attachment end comprising a full loop portion defining a transverse passage to receive an intermediate portion of the connector bar, first and second upper loop extensions projecting from the sides of said full loop portion to provide first and second lateral enclosures with open bottoms on opposite sides of said full loop portion for positioning adjacent the respective first and second lugs of the watchcase, and a pair of resilient legs attached to the bottom surface of the strap with one leg extending toward the first lateral enclosure and the other leg extending toward the second lateral enclosure, each leg terminating in an auxiliary full loop adapted to be at least partially received in a respective one of the first and second lateral enclosures and being adapted to define an auxiliary transverse passage to receive one of the opposite ends of the connector bar when the strap and connector bar are attached to the first and second lugs, said legs being sufficiently resilient that the auxiliary loops can each be moved along the connector bar toward or away from the first and second lugs to accommodate different lug spacings and, in conjunction with the full loop portion and first and second upper loop extensions, hide the connector bar from view.

3. The watch strap of claim 2 wherein one resilient leg is disposed on the strap bottom surface on one side of the full loop portion and the other leg is disposed on the other side of the full loop portion.

4. The watch strap of claim 2 made of molded plastic.

5. The watch strap of claim 2 wherein the full loop portion is centrally disposed between the lugs and the first and second upper loop extensions project equal distances therefrom, the total width of the full loop portion and first and second upper loop extensions equalling the minimum lug spacing to be encountered.

6. The watch strap of claim 5 wherein the auxiliary full loops each have a width at least slightly greater than one-half the difference between the minimum lug spacing and maximum lug spacing to be encountered.

* * * * *